United States Patent [19]

Anderson

[11] Patent Number: 5,065,938

[45] Date of Patent: Nov. 19, 1991

[54] GABLE TOP CARTON WITH RESEALABLE POUR SPOUT

[75] Inventor: Nestor A. Anderson, Parsippany, N.J.

[73] Assignee: Champion International Corporation, Stamford, Conn.

[21] Appl. No.: 405,134

[22] Filed: Sep. 11, 1989

[51] Int. Cl.[5] ..... B65D 5/74

[52] U.S. Cl. ..... 229/125.08; 220/258; 220/339; 229/125.15

[58] Field of Search ..... 206/621, 621.1, 621.2, 206/621.7, 620; 220/85 SP, 254, 259, 258, 306, 338, 339; 222/541, 556, 557, 566; 229/125.04, 125.08, 125.09, 125.14, 125.15, 125.18

[56] References Cited

U.S. PATENT DOCUMENTS

| | | | |
|---|---|---|---|
| 2,321,050 | 6/1943 | Seymer | 229/125.09 |
| 2,400,716 | 5/1946 | Sattler | 229/125.15 |
| 2,673,021 | 3/1954 | Nordquist | 229/125.09 |
| 2,676,744 | 4/1954 | Baselt . | |
| 2,927,695 | 3/1960 | Bartolomeo . | |
| 3,127,082 | 3/1964 | Meuer-Jagenberg | 229/125.09 |
| 3,239,112 | 3/1966 | Porcelli | 222/541 |
| 3,250,436 | 5/1966 | Kurtz | 229/125.15 |
| 3,460,739 | 8/1969 | Asman | 206/631.3 |
| 3,516,452 | 6/1970 | Scholle | 220/306 |
| 3,584,760 | 6/1971 | Grinker | 220/306 |
| 4,359,169 | 11/1982 | Helms et al. . | |
| 4,562,936 | 1/1986 | Deflander | 206/621.7 |
| 4,591,091 | 5/1986 | Wise | 206/620 |
| 4,770,325 | 9/1988 | Gordon et al. | 222/541 |
| 4,775,098 | 10/1988 | Peer, Jr. et al. . | |
| 4,782,996 | 11/1988 | Spahni, Jr. . | |
| 4,783,056 | 11/1988 | Abrams . | |
| 4,801,037 | 1/1989 | Hayashida et al. | 229/125.08 |
| 4,807,787 | 2/1989 | Langmeier et al. | 222/541 |
| 4,813,578 | 3/1989 | Gordon et al. | 206/621 |

FOREIGN PATENT DOCUMENTS

| | | | |
|---|---|---|---|
| 572850 | 3/1959 | Canada . | |
| 167095 | 1/1986 | European Pat. Off. | 229/125.04 |
| 1054008 | 3/1959 | Fed. Rep. of Germany . | |
| 2659275 | 7/1978 | Fed. Rep. of Germany | 229/125.42 |
| 363931 | 9/1962 | Switzerland | 229/125.04 |

*Primary Examiner*—Gary E. Elkins
*Attorney, Agent, or Firm*—Evelyn M. Sommer

[57] ABSTRACT

A gable top carton is provided with a bottom wall, an upstanding side wall enclosure connected to and extending from the bottom wall, and a gable top. The gable top is defined by an opposed pair of triangular top panels hingedly connected to opposed portions of the side wall enclosure, and a pair of opposed rectangular top panels hingedly connected to the side walls and folded over the triangular top panels. The triangular top panels and the rectangular top panels are connected to one another by triangular top web panels. One of the triangular top panels is provided with a pouring aperture formed therethrough or with an array of preforations for defining a pouring aperture. A resealable pouring spout is affixed to the triangular top panel having the pouring aperture therein. The resealable pouring spout includes a base securely affixed to the triangular top panel. The base includes an aperture in register with the aperture in the carton. The resealable pouring spout further includes a cover hingedly connected to the base and securely but releasably engageable with the base to close the carton but permit selective opening thereof. The cover is initially prevented from opening by the web panels adjacent thereto and portions of the rectangular top panels.

19 Claims, 3 Drawing Sheets

GABLE TOP CARTON WITH RESEALABLE POUR SPOUT

BACKGROUND OF THE INVENTION

Gable top cartons are widely used for flowable material that must periodically be dispensed for use by a consumer, and that must efficiently be stored between uses. Gable top cartons are most widely used with liquids, such as dairy products and juices. However, gable top cartons also are used efficiently with flowable powders or granular material, such as detergents, pet foods, fertilizers and the like.

The typical prior art gable top carton comprises a square bottom wall. Opposed pairs of rectangular side walls are consecutively connected to one another and are connected respectively to the bottom wall. The gable top is connected to portions of the side walls opposite the bottom wall. The gable top of the typical prior art carton comprises a pair of rectangular roof or top panels articulated to opposed side wall panels and a pair of isosceles triangular top or pour panels articulated to the other pair of opposed rectangular side wall panels. The isosceles triangular top panels are connected to the rectangular top panels by triangular web panels. The prior art gable top carton is closed by rotating the isosceles triangular top panels inwardly and toward one another. This inward rotation of the triangular top panels urges the rectangular top panels towards one another. The gable top of the prior art carton is sealed along top edge regions of the rectangular top panels, the triangular top panels and the web panels.

The sealing of the prior art gable top must be sufficiently secure to prevent spoilage of the pourable material stored in the carton. However, at least one half of the prior art gable top must be selectively openable to permit relatively easy pouring of the material stored therein. The relatively easy opening of the prior art gable top carton is achieved by selective application of adhesive and abhesive along portions of the top edge regions of selected panels defining the gable top. The abhesive or the relative absence of adhesive is intended to facilitate the separation of the adequately secured and sealed prior art gable top. However, despite the careful design and manufacture of prior art gable top cartons, many consumers experience considerable difficulty in attempting the initial opening of the prior art gable top carton. For example, consumers may attempt to open the half of the prior art gable top carton that has not been provided with an abhesive material which is intended to facilitate opening. This securely and permanently sealed half of the prior art gable top is very difficult to efficiently open into a pouring spout. Consequently, the consumer will generally permanently damage the container and will experience dissatisfaction with both the container and the product. In many other instances, a consumer will experience considerable difficulty in attempting to efficiently open the intended side of the prior art gable top. In particular, the consumer is likely to damage the edge regions of the pouring spout, thereby affecting both the ability to efficiently pour the flowable material and the ability to reseal the prior art carton. Consumers generally do not encounter difficulties in separating the top seal region and folding back portions of the rectangular top or roof panels. Rather, the difficulties are encountered in attempting t separate the top edge regions of the web panels from the top edge regions of the rectangular top or roof panels to enable the outward folding of the isosceles triangular pour spout.

In view of the above described problems with the prior art gable top cartons, there has developed a very significant commercial demand for blow molded plastic containers with plastic caps releasably secured thereto. The plastic containers are perceived by many consumers to be considerably easier to open. However, it is widely known that the blow molded plastic containers create very substantial environmental problems as compared to the biodegradable paperboard gable top cartons.

The prior art has included attempts to incorporate a resealable plastic pour spout in one of the rectangular roof panels of the gable top carton. These prior art attempts at incorporating a plastic pouring spout into a rectangular roof panel of a gable top are intended to avoid the above described problems encountered by consumers attempting to initially open the prior art gable top carton. However, it has been difficult and costly to provide adequate initial sealing and tamper evidence for the plastic pouring spout in the rectangular top panel. In particular, it has been necessary to provide adequate sealing of the plastic pouring spout in the rectangular top or roof panel to prevent spoilage of the pourable material stored in this prior art gable top carton. However, it has been difficult to provide an efficient sealing means that can be separated from the plastic pouring spout without damaging either the adhesive closure of the gable top panel or the adhesive attachment of the plastic pouring spout to the rectangular roof panel. It has also been difficult to provide adequate tamper evidence means without adding significantly to the cost of the prior art gable top carton and/or without creating ne opening difficulty. Additionally, the plastic pouring spouts incorporated into the rectangular roof panels have not been efficiently resealable to positively prevent spoilage of the flowable material between uses.

The prior art also includes molded plastic aseptic vials and caps that are used primarily for medical and laboratory applications. These aseptic vials and caps and methods of making them are disclosed in U.S. Pat. No. 4,783,056 which issued on Nov. 8, 1988 to Robert S. Abrams and U.S. Pat. No. 4,812,116 which issued on Mar. 14, 1989 also to Robert S. Abrams. The above referenced teaching relating to aseptic vials and cap has not heretofore been incorporated into other container art areas and in particular the paperboard container art.

In view of the above, it is an object of the subject invention to provide an improved gable top carton.

It is another object of the subject invention to provide a gable top carton that incorporates a plastic pour spout therein for efficiently pouring flowable material from the gable top carton.

It is an additional object of the subject invention to provide a gable top carton with a plastic pour spout that provides for efficient initial sealing with tamper evidence.

A further object of the subject invention is to provide a gable top carton with a plastic pour spout that provides for efficient resealing of the pour spout between alternate uses.

SUMMARY OF THE INVENTION

The subject invention is directed to a gable top carton having a reclosable pouring spout incorporated therein. The invention further is a directed to a plurality of components for assembling a reclosable gable top carton, including a paperboard blank and a separate resealable plastic pouring spout.

The gable top carton of the subject invention comprises a bottom wall, an upstanding side wall enclosure connected to and extending from the bottom wall and a gable top connected to and extending from portions of the side wall enclosure opposite the bottom wall. In the typical embodiment the side wall enclosure of the carton will be defined by opposed pairs of generally rectangular side walls that are articulated respectively to one another and that are foldably connected to the bottom wall. In this typical embodiment, each side wall will be substantially orthogonal to the bottom wall, and each side wall will be substantially perpendicular to the side walls articulated thereto. However, other side wall constructions are possible, including a side wall joined to a generally circular bottom and gradually merging into a top of rectangular cross section.

The top of the subject gable top carton may comprise a pair of opposed rectangular top panels articulated to opposite top portions of the side walls, and a pair of isosceles triangular top panels which also are articulated to the opposed top portions of the side walls. The isosceles triangular top panels are joined to the rectangular top panels by triangular web panels which extend therebetween. The rectangular top panels and the web panels are provided with top regions or flaps articulated thereto which are sealable to securely close the gable top. One of the top panels of the subject carton preferably is provided with pouring aperture means, such as a cutout extending therethrough or an array of perforations that can define a pouring aperture. The pouring aperture preferably is circular, but may be other configurations as desired. Preferably the pouring panel is in one of the triangular top panels to provide tamper resistance and tamper evidence as explained herein. However, in certain embodiments the pouring aperture may be in a rectangular top panel.

The carton of the subject invention further comprises a resealable pouring spout which is mounted to the triangular top panel having the aperture therein. The resealable pouring spout may be formed from a plastic material, and may be of unitary molded construction. In particular, the resealable pouring spout preferably comprises a base and a cover hingedly connected to the base. The base may comprise a generally planar mounting flange which may be securely affixable to the triangular top panel having the pouring aperture means. The base may further be provided with an aperture corresponding generally in size and shape to the pouring aperture means in the triangular top panel of the carton. The base of the subject closure may further comprise a pouring flange substantially surrounding the aperture in the base. The pouring flange may be circular in shape and may extend generally perpendicularly from the mounting flange of the base.

The cover of the pouring spout may conform to the shape of the aperture extending through the base, and may comprise means for lockingly but releasably engaging the pouring flange of the base. In particular, the cover may comprise generally annular concentric locking walls with an annular groove therebetween for lockingly but releasably receiving the annular pouring flange of the base. The cover may further be provided with a lift tab at a location thereon generally opposite the hinged connection of the cover to the base. The lift tab may be dimensioned to be readily engaged by the thumb and/or forefinger of a user of the subject carton.

In embodiments having the pouring spout mounted to a triangular top panel, the cover of the pouring spout may be constructed to be lockingly engaged by the triangular web panels when the gable top is sealed. More particularly, the triangular web panels of the gable top may securely engage the outer surface of the cover to prevent tampering with the pouring spout or to at least provide evidence of tampering. The gable top carton of the subject invention may be selectively opened by folding the triangular web panels surrounding the subject pouring spout away from one another and back toward the rectangular top panels, as is generally done in the initial stage of opening the conventional prior art gable top carton. However, unlike the conventional prior art gable top carton, it is unnecessary to perform the sometimes difficult task of folding the triangular web panels outwardly and away from the rectangular top or roof panels. Rather, after this initial separation of the web panels from one another, the user need merely grasp the lift tab on the cover of the subject pouring spout and rotate the cover away from the base. The flowable material in the carton may then be poured in substantially the conventional manner, and the carton can be resealed by merely urging the cover back into secure engagement with the base. Subsequent reopenings and reclosings can be carried out in substantially the same manner, with the resealed carton of the subject invention being substantially more secure than conventional prior art gable top cartons that have been reclosed.

It will be appreciated that the cover of the subject pouring spout can not readily be rotated away from the base until the triangular web panels have been folded away from one another to access the cover. This separation of the triangular web panels thus provides clear evidence of opening and/or tampering prior to the purchase of the subject carton. This clear tamper evidence when combined with the secure sealing enabled by the above described pouring spout makes it unnecessary to provide a redundant seal over the aperture in the base of the subject closure. However, such a redundant seal may be provided if it is deemed desirable for certain uses.

The subject invention is further directed to the assembly of components for forming the above described gable top carton. In this regard, the components comprise a blank formed from a foldable flexible material having a plurality of panels articulated to one another along score lines, plus a separate pouring spout that is attachable to the blank. The blank of the subject invention may be formed from a paperboard material or from a composite material having a plurality of laminated layers which may include a plastic or foil coating. The blank includes a side wall which may be formed from a plurality of side wall panels consecutively articulated to one another. Bottom wall panels are articulated to one end of each respective side wall panel, and top wall panels are articulated to the opposed ends of the respective side wall panels. The top wall panels comprise rectangular top panels and triangular top panels. Web panels are articulated to and extend between the rectangular and triangular top panels. One of the top panels is provided with a pouring aperture means such as perforations or a cutout extending therethrough.

The pouring spout of the subject assembly comprises a base and a cover. The pouring spout preferably is unitarily molded from a plastic material. The base of the subject closure preferably comprises a generally planar mounting flange and a generally annular cylindrical pouring flange extending orthogonally from the mounting flange. The cover preferably comprises a pair of spaced apart concentric locking flanges which are disposed and dimensioned to engage opposite respective sides of the pouring flange. A flexible hinge is unitarily connected to and extending between the cover and the base. A lift tab may further be unitarily connected to the cover.

The base of the pouring spout may be securely affixed to the blank prior to its erection into a gable top carton, or may be secured thereto as part of the carton erection process. The carton is erected by rotating the side wall panels consecutively toward one another to define a generally tubular construction. The bottom wall panels then are articulated relative to the side wall panels to form the bottom of the carton in substantially the conventional manner. Similarly, the top of the subject carton is closed in substantially the conventional manner. However, unlike the conventional prior art carton, the sealing of the gable top securely retains the cover of the pouring spout in secure sealing relationship to the base thereof.

DETAILED DESCRIPTION OF THE PREFERRED EMBODIMENT

Figure 1:
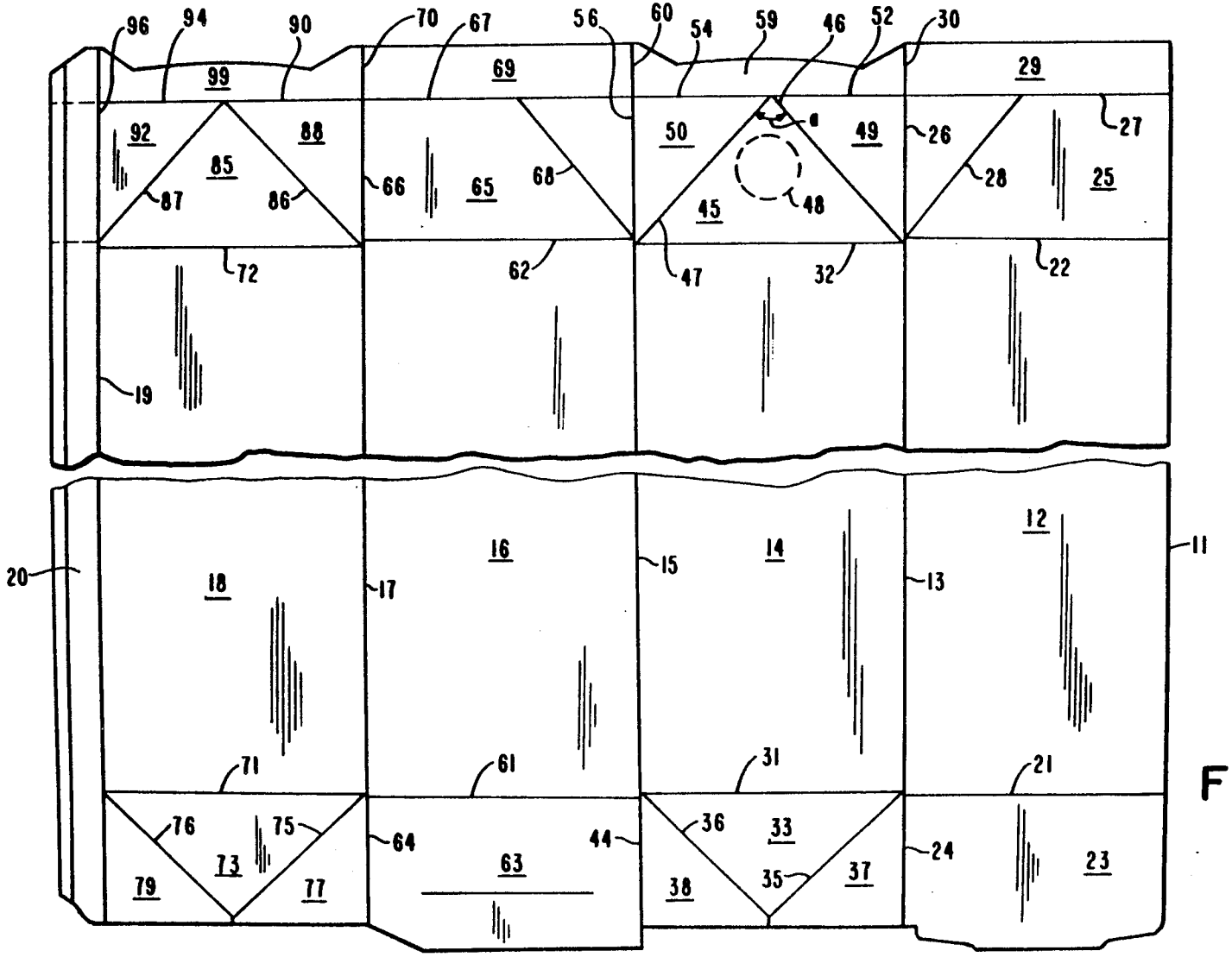
FIG. 1 is a top plan view of a blank in accordance with the subject invention.
Figure 2:
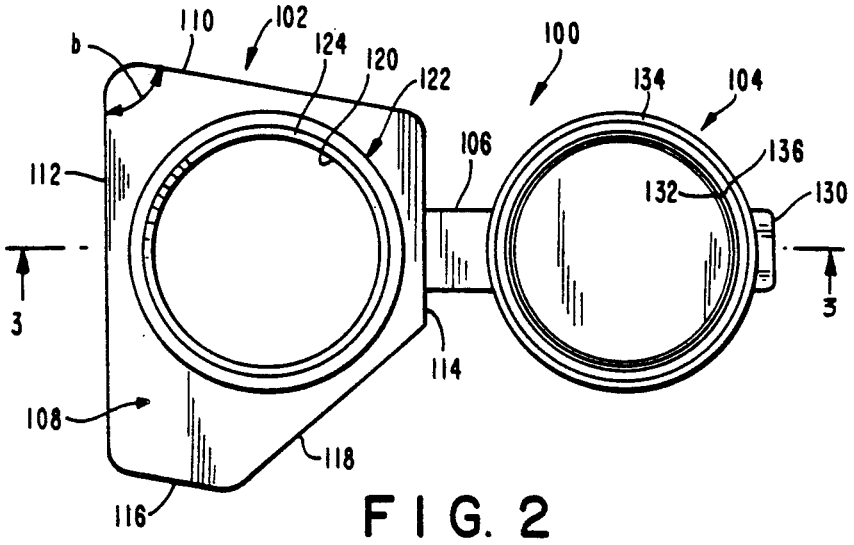
FIG. 2 is a top plan view of the pouring spout of the subject invention in an opened condition.

A blank for the carton of the subject invention is illustrated in FIG. 1, and is identified generally by the numeral 10. The blank 10 is of unitary construction, and is formed from a paperboard material which may be coated or laminated with plastic or foil on at least side thereof. The presence of a coating and the type of coating will be dependent upon the type of flowable material to be stored in the carton erected from the blank 10.

The blank 10 is provided with a plurality of score lines formed therein to divide the blank 10 into a plurality of panels which can be folded about the score lines to erect the blank 10 into the carton of the subject invention. In particular, the blank 10 includes a rectangular first side panel 12, a rectangular second side panel 14, a rectangular third side panel 16, a rectangular fourth side panel 18 and a side glue panel 20, all of which are consecutively articulated to one another along substantially parallel fold lines 13, 15, 17 and 19 respectively.

The first side panel 12 of the blank 10 is further defined by a side edge 11 which extends generally parallel to the fold line 13. The edge 11 will be disposed generally adjacent to the fold line 19 on the erected carton, while areas of the first side panel 12 adjacent to the edge Il will be adhered to the side fold panel 20 on the erected carton. The first side panel 12 further is defined by parallel first bottom and first top fold lines 21 and 22 respectively which extend between the side edge I and the fold line 13 and which are generally perpendicular thereto. A first bottom panel 2 is hingedly connected to the first side panel 12 along first bottom fold line 21. The first bottom panel 23 is further defined by fold line 24 which is substantially collinear with the fold line 13.

A generally rectangular first top panel 25 is hingedly connected to the first side panel 12 along the first top fold line 22. The first top panel 25 is further defined by fold line 26 which is substantially collinear with the fold lines 13 and 24 and by fold line 27 which is substantially parallel to the top fold line 22. The first top panel 25 is further characterized by a diagonal score line 28 which extends generally from the intersection of first top fold line 22 and fold line 26 to a location along the length of fold line 27, as illustrated in FIG. 1. The score line 28 facilitates the folding back of the rectangular first top panel 25 during opening of the carton as explained further herein. A top seal panel 29 is articulated to the first top panel 25 along fold line 27. The top seal panel is further defined by fold line 30 which extends collinearly from the fold lines 24, 13 and 26.

The second side panel 14 is further defined by second bottom and second top fold lines 31 and 32 respectively which are generally parallel to one another and extend orthogonally between the fold lines 13 and 15. An isosceles triangular second bottom panel 33 is hingedly connected to the second side panel 14 along the second bottom fold line 31. The second bottom panel 33 is further defined by converging fold lines 35 and 36. Bottom web panels 37 and 38 are articulated to the second bottom panel 33 along fold lines 35 and 36 respectively. The bottom web panel 37 is further articulated to the first bottom panel 23 along fold line 24. The bottom web panel 38 is further defined by fold line 44 which extends collinearly from the fold line 15.

A second top panel 45 is hingedly connected to the second side panel 14 along the second top fold line 32. The second top panel 45 is of substantially isosceles triangular configuration, and is further defined by converging fold lines 46 and 47 which intersect at angle "a". The second top panel 45 is further characterized by a generally circular array of perforations 48 which enable a circular portion of the paperboard material defining the second top panel 45 to be at least in part separated from the blank 10. This separation may occur at a subsequent stage during the formation of the carton from the blank 10, and may be in response to the affixation of the plastic pouring spout to the second top panel 45 as explained further herein. Alternatively, the second top panel may initially be provided with a cutout for pouring material.

Top web panels 49 and 50 are articulated to the second top panel 45 along fold lines 46 and 47 respectively. The top web panel 49 is further defined by the fold line 26 and by fold line 52. The top web panel 50 is further defined by fold line 54 which extends collinearly with fold lines 27 and 52 and by fold line 56 which extends collinearly with fold lines 44 and 15. A second top seal panel 59 is articulated to the top web panels 49 and 50 along fold lines 52 and 54 respectively. The second top seal panel is further articulated to the first top seal panel 29 along fold line 30. The second top seal panel 58 is further defined by fold line 60 which extends generally collinearly from the fold line 56.

The third side panel 16 is further defined by bottom and top fold lines 61 and 62 which extend generally parallel to one another and generally orthogonally between the fold lines 15 and 17. A third bottom panel 63 is articulated to the third side panel 16 along the third bottom fold line 61. The third bottom panel 63 is articulated to the bottom web panel 38 along fold line 44, and is further defined by fold line 64 which extends collinearly from the fold line 17.

A third top panel 65 is articulated to the third side panel 16 along the third top fold line 62. The third top panel 65 is articulated to the top web panel 50 along fold line 56 and is further defined by fold lines 66 and 67. In particular, the fold line 66 extends generally collinearly from the fold lines 64 and 17 and generally parallel to the fold line 56. The fold line 67 extends generally parallel to the fold line 6 and collinearly with the fold line 54. The third top panel 65 is further characterized by a diagonal score line 68 which extends generally from the intersection of fold lines 56 and 62 to a location intermediate along the length of the fold line 67. The diagonal score line 68 substantially corresponds to the diagonal score line 28 on the first top panel 25. More particularly, the score line 68 enables a corner of the third top panel 65 to be folded back as part of the opening of the carton formed from the blank 10.

A third top seal panel 69 is articulated to the third top panel 65 along fold line 67. The third top seal panel 69 is hingedly connected to the second top seal panel 58 along fold line 60, and is further defined by fold line 70 which extends collinearly from fold lines 64, 17 and 66.

The fourth side panel 18 is further defined by fold lines 71 and 72 which are parallel to one another and extend orthogonally between the fold lines 17 and 19. A triangular fourth bottom panel 73 is hingedly connected to the fourth side panel 18 along fourth bottom fold line 71, and is further defined by converging fold lines 75 and 76. A bottom web panel 77 is articulated to the fourth bottom panel 73 along the fold line 75, and is further articulated to the third bottom panel 63 along fold line 64. Bottom web panel 79 is articulated to the fourth bottom panel 73 along fold line 76, and is further defined by fold line 80 which extends collinearly from the fold line 19.

A fourth top panel 85 is articulated to the fourth side panel 18 along a fourth top fold line 72. The fourth top panel 85 is of substantially isosceles triangular configuration, and is defined by converging fold lines 86 and 87. Unlike the isosceles triangular second top panel 45, the fourth top panel 85 is not provided with a circular array of perforations or a cutout, but rather is of substantially continuous construction. A top web panel 88 is articulated to the fourth top panel 85 along fold line 86. The top web panel 88 is further articulated to the third top panel 65 along fold line 66, and is further defined by fold line 90 which extends collinearly from the fold line 67. A top web panel 92 is articulated to the fourth top panel 85 along fold line 87. The top web panel 92 is further defined by fold line 94 which extends collinearly from the fold line 90 and by fold line 96 which extends collinearly from the fold line 19. A fourth top seal panel 98 is articulated to the top web panels 88 and 92 along fold lines 90 and 94 respectively.

The blank 10 described above and illustrated in FIG. 1 is used in combination with a pouring spout identified generally by the numeral 100 in FIGS. 2-5. The closure 100 is unitarily molded from a plastic material and includes a base 102 and a cover 104. The cover 104 is hingedly connected to the base 102 by a flexible hinge 106 which extends unitarily therebetween.

The base 102 includes a generally planar mounting flange 108 which is configured and dimensioned for placement on the second top panel 45 of the blank 10 described and illustrated above. More particularly, the mounting flange 108 is defined by top edges 110 and 112 which intersect one another at angle "b" which substantially equals the angle "a" at which the fold lines 46 and 47 of the second top panel 45 intersect. Edges 114 and 116 of the mounting flange 108 extend generally toward one another from the edges 110 and 112 respectively, while edge 118 extends between and connects the edges 114 and 116. The edges 110-116 of the mounting flange 108 are dimensioned such that the bottom edge 118 thereof is disposed to lie parallel and/or substantially adjacent to the second top fold line 32 which hingedly connects the second side panel 14 with the second top panel 45 on the blank 10.

The base 102 of the closure 100 is further characterized by a generally circular aperture 120 extending therethrough. A short cylindrical pouring flange 122 extends substantially orthogonally from the mounting flange 108 and substantially surrounds and defines the aperture 120 formed in the base 102. The pouring flange 122 includes an enlarged top lip 124 which is lockingly but releasably engageable with the cover 104 as explained further herein.

Figure 3:
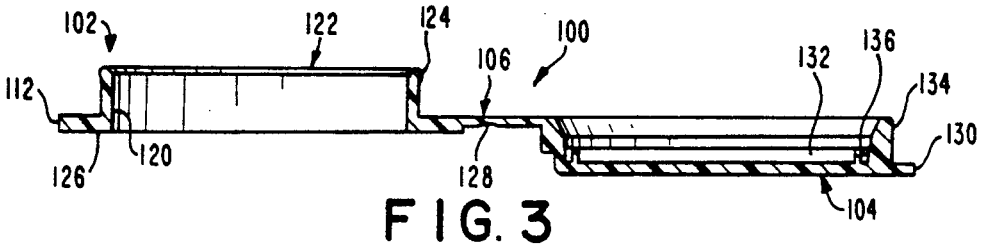
FIG. 3 is a cross-sectional view taken along line 3—3 in FIG. 2.

The bottom surface 126 of the base 108, as depicted most clearly in FIG. 3, is substantially planar to facilitate secure face-to-face adhesion or other such attachment to the second top panel 45 such that the circular aperture 120 in the base 102 can be placed in register with the circular array of perforations 48 or the resulting cutout in the second top panel 45. However, in certain embodiments, a portion of the pouring flange 122 may extend below the bottom surface 126 of the mounting flange 108 to substantially engage the corresponding circular cutout in the second top panel 45 and/or to cause the portion of the second top panel 45 within the circular array of perforations 48 to be separated from the remainder of the second top panel 45.

The hinge 106 which joins the base 102 with the cover 104 preferably is provided with an area 128 of minimum thickness which defines the hinge line about which the cover 104 rotates relative to the base 102.

The cover 104 is of generally circular construction slightly larger than the size of the circular aperture 120 in the base 102. The cover 104 is provided with a lift tab 130 which is dimensioned to be readily manipulated by a thumb and/or forefinger of a consumer using the carton formed from the blank 10. The cover 104 includes concentric annular inner and outer locking flanges 132 and 134 with a generally annular locking groove 136 defined therebetween. The locking groove 136 is dimensioned to be placed substantially in register with the pouring flange 122 of the base 102 upon rotation of the cover 104 about the hinge line 128 defined in the flexible hinge 106. However, the radial dimension of the annular groove 136 is less than the maximum radial dimension defined by the lip 12 at the top of the cylindrical pouring flange 122. As a result, the concentric locking flanges 132 and 134 will require minor deformation to resiliently engage the lip portion 124 of the cylindrical pouring flange 122. This deformation of one or both locking flanges 132 and/or 134 is facilitated by chamfered edges on the flanges 132 and 134. In this closed and releasably locked condition of the cover 104 relative to the base 102, the lip portion 124 of the cylindrical pouring flange 122 will be securely engaged between the concentric locking flange 132 and 134 of the cover 104. In particular, this engagement will be leakproof and airtight. Furthermore, the resilient characteristics of the plastic material from which unitary pouring spout 100 is molded readily permits frequent repetitive reopenings and resealings of the pouring spout 100.

It will be appreciated that the plastic material from which the pouring spout 100 is molded can be of any desired color. Thus, the plastic material can be molded to conform to any of the many colors printed onto the outer surface of conventional prior art gable top cartons.

Figure 4:
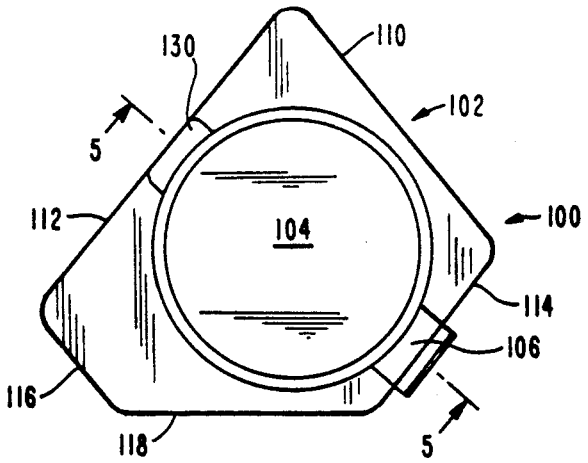
FIG. 4 is a top plan view of the pouring spout of FIG. 2 in a closed condition.
Figure 5:
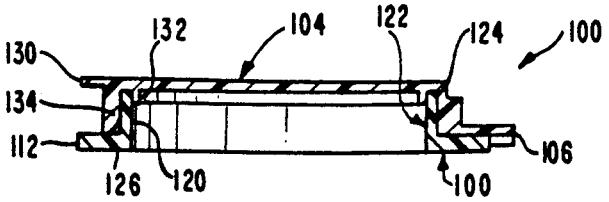
FIG. 5 is a cross-sectional view taken along line 5—5 in FIG. 4.

The base 102 of the resealable pouring spout 100 is secured to the second top panel 45 as part of the formation of the carton from the blank 10. The affixation of the base 102 to the second top panel 45 may be carried out at any of several stages of the carton erection process depending upon factors such as the particular equipment being employed to form the carton and the material to be stored therein. The base 102 is positioned on the second top panel 45 such that the aperture 120 in the base 102 is in register with the circular array of perforations 48 or the equivalent circular cutout in the second top panel 45. As noted above, the pouring flange 122 of the base 102 may extend below the planar bottom surface 126 of the mounting flange 108 to cause a separation of the portion of the second top panel 45 defined by the circular array of perforations 48, and/or to securely engage the edge defining the circular cutout in the second top panel 45. The mounting flange 108 is positioned such that the edges 110 and 112 thereof are substantially in register with the fold lines 46 and 47 respectively, and such that the edge 118 thereof is substantially parallel to and/or aligned with the fold line 32. In the closed condition of the closure 100 as depicted in FIGS. 4 and 5, the tab 130 on the cover 104 will also be substantially in register with the fold line 47 connecting the second top panel 45 to the top web panel 50. The affixation of the base 102 of the resealable pouring spout 100 to the second top panel 45 preferably is by heat sealing, but may also be by ultrasonic welding or other appropriate adhesive means.

Figure 6:
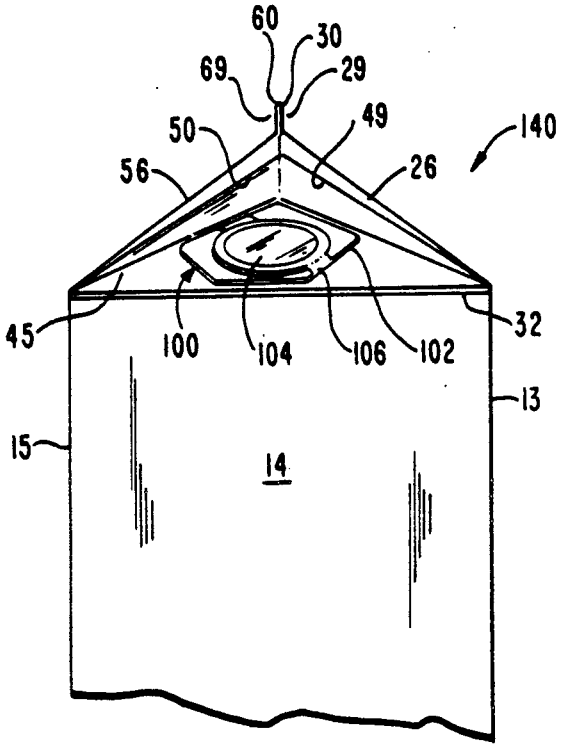
FIG. 6 is a side elevational view of the sealed gable top carton in accordance with the subject invention.
Figure 7:
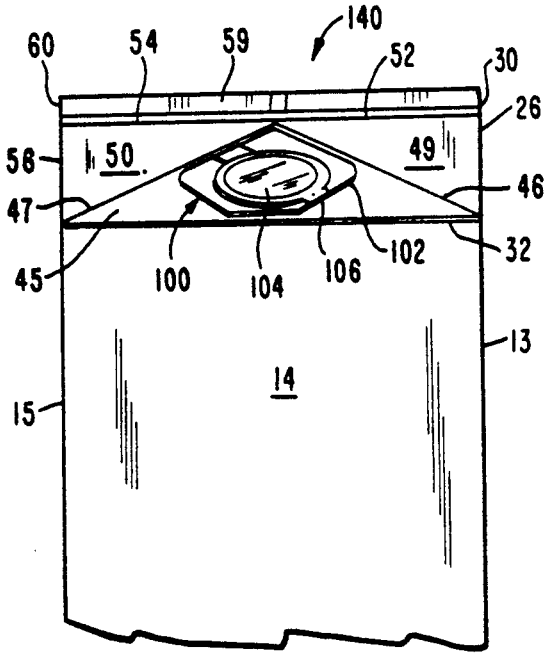
FIG. 7 is a side elevational view similar to FIG. 6 but showing the carton in a partially opened condition.
Figure 8:
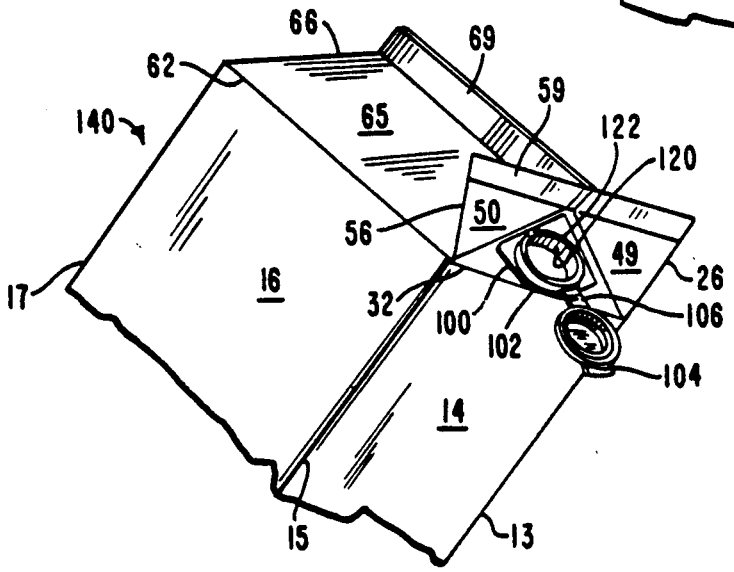
FIG. 8 is a perspective view showing the subject gable top carton opened and in use.

The carton 140 shown in FIGS. 6–8 is erected from the blank 10 in substantially the known manner. In particular, the first through fourth side wall panels 12–18 and the glue panel 20 are rotated about the respective fold lines 13–19, and the glue panel 20 is adhered to the first side panel 12 such that the edge 11 is adjacent and in register with the fold line 19. The tubular structure defined at this stage in the erection of the carton includes opposed substantially parallel first and third side walls 12 and 16 and opposed substantially parallel second and fourth side walls 14 and 18. The first through fourth bottom walls 23, 33, 63 and 73 are then rotated inwardly about the respective first through fourth bottom fold lines 21, 31, 61 and 71 and are appropriately sealed in the known manner to define the substantially planar bottom wall of the carton. At this stage in the carton erection process, an opened top container has been defined. The container may at this time be filled with an appropriate flowable material which may be any of the liquid, powder or granular materials referred to above, or any others not specifically identified herein.

The gable top of the carton 140 is closed by rotating the triangular second and fourth top panels 45 and 85 inwardly toward one another about the respective second and fourth top fold lines 32 and 72. Simultaneously, the first and third rectangular top panels 25 and 65 are rotated inwardly about the first and third top fold lines 22 and 62. As noted above, prior art gable top cartons were sealed along the top seal flaps 29, 59, 69 and 99 by careful application of adhesive and abhesive to facilitate opening of a paperboard pour spout. However, the subject carton 140 does not require the creation of a paperboard pour spout, and therefore does not require the careful application of adhesive and abhesive as had been required in the prior art. Rather, the top seal may be achieved by a heat seal without the careful application of the abhesive required in the prior art. In this closed condition of the carton 140, as shown most clearly in FIG. 6, the opening tab 130 of the cover 104 will be rendered substantially inaccessible by the top web panel 50 and the third rectangular top panel 65 which are generally adjacent thereto and which are temporarily retained in this closed position by the heat sealing of the top seal flaps 29, 59 and 69. Additionally, regions of the cover 104 adjacent to the tab 130 will be closely engaged by the top web panels 49 and 50 as shown in FIG. 6. In view of this construction, the cover 104 is not readily removable from the base 102 without first separating the opposed halves of the second top seal panel 59 from one another by rotating the top web panels 49 and 50 away from one another and about the respective fold lines 46 and 47 as shown in FIG. 7. This partial opening of the gable top, as depicted in FIG. 7, generally can be accomplished without difficulty by consumers. Rather, the difficulty of opening a prior art gable top carton had been encountered during the subsequent opening stage with the prior art carton, wherein the seal panels were further separated to enable the outward folding of the triangular second top panel. This stage of the opening is not required with the container 140. In particular, the material stored in the container 140 can be accessed readily by merely exerting an upward force on the tab 130 of the cover 104 once the container 140 is in the partly opened condition depicted in FIG. 7. This upward force on the tab 130 will enable the cover 104 to pivot about the hinge 106 into the orientation depicted in FIG. 8, to enable convenient pouring of the flowable material stored in the container 140. The container 140 can be conveniently resealed by merely rotating the cover 104 about the hinge 106 and back toward the base 102. A slight force exerted on the cover will enable the concentric locking flanges 132 and 134 to securely engage the cylindrical pouring flange 122 therebetween to achieve an airtight seal. Reopening and reclosing can readily be achieved.

It will be appreciated that the cover 104 can not readily be rotated away from the base 102 without first rotating the top web panels 49 and 50 away from one another into the FIG. 7 orientation. This initial opening of the carton 140 into the FIG. 7 orientation provides readily apparent evidence of tampering. As a result, it is not necessary to provide any further seals over the opening 120 in the pouring spout 100. However, additional seals can be provided if required or preferred for some particular application of the carton 140.

In summary, a gable top carton is provided with a plastic resealable pouring spout fixedly attached to one of the triangular top panels of the carton. The pouring spout includes a base having an aperture extending therethrough for placement generally in register with a corresponding pour aperture means formed in the triangular top panel. The closure further includes a cover hingedly connected to the base and securely but releasably engageable with portions of the base surrounding the pouring aperture means therein. The closure of the gable top urges triangular web panels and the rectangular top panels tightly against the cover of the resealable pouring spout to prevent removal of the cover from the base prior to purchase. The consumer can access the material stored in the carton by initially rotating the web panels and triangular corner portions of the rectangular top panels away from the resealable pouring spout to access the cover. The cover can be conveniently and securely reclosed and reopened as needed. The subject invention further is directed to the assembly of components for forming the above described carton. In particular, the assembly of components includes a paperboard blank for forming the carton and a separate pouring spout attachable to the blank. The closure of this assembly preferably is unitarily molded from a plastic material.

While the invention has been described with respect to a preferred embodiment, it is apparent that various changes can be made without departing from the scope of the invention as defined by the appended claims.

I claim:

1. A gable top carton comprising:

a carton having a bottom wall, an upstanding side wall enclosure connected to and extending from the bottom wall, a pair of opposed triangular top walls hingedly connected to opposed portions of the side wall enclosure at locations thereon remote from the bottom wall, a pair of opposed generally rectangular top walls hingedly connected to opposed portions of the upstanding side wall enclosure at locations thereon remote from the bottom wall, triangular web panels connected to and extending between the respective triangular top panels and the rectangular top panels, said rectangular top panels and said triangular web panels being folded into generally overlying relationship to the triangular top panels, and being sealed to one another at portions thereof remote from the side wall enclosure, a first of said triangular top panels being provided with an aperture means therein for permitting material stored in said carton to be poured therefrom; and a resealable pouring spout securely connected to the first triangular top panel in overlying relationship to the aperture means therein, said resealable pouring spout comprising a base having an opening extending therethrough, said base being affixed to the first triangular top panel such that the opening in the base is substantially in register with the aperture means in the first triangular top panel. and a cover hingedly connected to the base and selectively engageable therewith for securely closing the opening in the base and the aperture means in the first triangular top panel, the cover of the resealable pouring spout includes a lift tap at a location thereon generally opposite the hinged connection of the cover to the base, said lift tab being disposed generally adjacent one of the hinged connections of the first triangular top panel to said triangular web panels.

2. A carton as in claim 1 wherein the resealable pouring spout is unitarily molded from a plastic material.

3. A carton as in claim 1 wherein the base of the resealable pouring spout comprises a substantially planar mounting flange securely affixed to the first triangular top panel and a generally cylindrical pouring flange extending unitarily from the mounting flange and being substantially in register with the aperture means in the first triangular top panel of the carton.

4. A carton as in claim 3 wherein the cover includes inner and outer concentric locking flanges extending therefrom and in spaced relationship to one another to define an annular locking groove therebetween, said annular locking groove of said cover being dimensioned to securely but releasably engage the pouring flange of the base.

5. A closure as in claim 4 wherein the pouring flange comprises an enlarged lip at a location thereon remote from the mounting flange, said lip defining a radial dimension greater than the width of the locking groove in the cover, such that the engagement of the cover with the base requires deformation of at least one of said concentric locking flanges on the cover for 6. A carton as in claim 1 wherein the hinged connection of the cover of said resealable pouring spout to the base thereof is at a location spaced from the triangular web panels articulated to said first triangular top panel.

7. A carton as in claim 1 wherein the triangular web panels articulated to the first triangular top panel are disposed substantially adjacent the cover of the resealable pouring spout for preventing removal of the cover from the base, whereby the carton is openable by initially rotating the triangular web panels articulated to the first triangular top panel away from said first triangular top panel.

8. A carton as in claim 1 wherein the base of the resealable pouring spout is securely affixed to the first triangular top panel by ultrasonic welding.

9. A carton as in claim 1 wherein the base of the resealable pouring spout is securely affixed to the first triangular top panel by heat sealing.

10. A carton as in claim 1 wherein the base of the resealable pouring spout is securely affixed to the first triangular top panel by an adhesive.

11. A carton as in claim 1 wherein the secure attachment of regions of the gable top remote from the side wall enclosure is substantially free of abhesive.

12. A carton as in claim 1 wherein the gable top is securely closed by heat sealing.

13. A carton as in claim 1 wherein said upstanding side wall enclosure comprises four rectangular side walls consecutively articulated to one another.

14. A gable top carton comprising:

a carton having a bottom wall, an upstanding side wall enclosure connected to and extending from the bottom wall, a pair of opposed triangular top walls hingedly connected to opposed portions of the side wall enclosure at locations thereon remote from the bottom wall, a pair of opposed generally rectangular top walls hingedly connected to opposed portions of the upstanding side wall enclosure at locations thereon remote from the bottom wall, triangular web panels connected to and extending between the respective triangular top panels and the rectangular top panels, said rectangular top panels and said triangular web panels being folded into generally overlying relationship to the triangular top panels, and being sealed to one another at portions thereof remote from the side wall enclosure, a first of said triangular top panels being provided with an aperture means therein for permitting material stored in said carton to be poured therefrom; and a resealable pouring spout securely connected to the first triangular top panel in overlying relationship to the aperture means therein, said resealable pouring spout comprising a base having an opening extending therethrough, said base being affixed to the first triangular top panel such that the opening in the base is substantially in register with the aperture means in the first triangular top panel, and a cover hingedly connected to the base and selectively engageable therewith for securely closing the opening in the base and the aperture means in the first triangular top panel, said cover being selectively hingedly rotatable away from the base for opening the aperture in the first triangular top panel, said cover being dimensioned and disposed to prevent the hinged rotation of the cover away from the base when the triangular web panels and the rectangular top panels are sealed in overlying relationship to the first triangular top panel whereby the triangular web panels and the rectangular top panels provide tamper evidence and ensure secure closure of the carton.

15. A carton as in claim 14 wherein the resealable pouring spout is unitarily molded from a plastic material.

16. A carton as in claim 14 wherein the base of the resealable pouring spout comprises a substantially planar mounting flange securely affixed to the first triangular top panel and a generally cylindrical pouring flange extending unitarily from the mounting flange and being substantially in register with the aperture means in the first triangular top panel of the carton.

17. A carton as in claim 16 wherein the base of the resealable pouring spout is securely affixed to the first triangular top panel by ultrasonic welding.

18. A carton as in claim 16 wherein the base of the resealable pouring spout is securely affixed to the first triangular top panel by heat sealing.

19. A carton as in claim 16 wherein the base of the resealable pouring spout is securely affixed to the first triangular top panel by adhesive.

* * * * *